United States Patent [19]

Brennan et al.

[11] Patent Number: 4,565,077

[45] Date of Patent: Jan. 21, 1986

[54] LIQUID TREATING APPARATUS

[75] Inventors: Michael F. Brennan, Leola; Harold L. Kauffman, Lititz, both of Pa.

[73] Assignee: Armstrong World Industries, Inc., Lancaster, Pa.

[21] Appl. No.: 321,915

[22] Filed: Nov. 16, 1981

[51] Int. Cl.[4] ..... D06F 3/22

[52] U.S. Cl. ..... 68/158; 68/175; 68/181 R

[58] Field of Search ..... 68/181 R, 184, 175, 68/158, 5 E; 134/15

[56] References Cited

U.S. PATENT DOCUMENTS

| | | | |
|---|---|---|---|
| 2,764,009 | 9/1956 | Sarti | 68/158 |
| 2,779,183 | 1/1957 | Fornelli | 68/181 R |
| 3,068,774 | 12/1962 | Barstow | 68/175 X |
| 3,353,380 | 11/1967 | Taylor, Jr. | 68/181 R |
| 3,608,340 | 9/1971 | Fleissner | 68/184 X |
| 3,645,116 | 2/1972 | Peter | 68/5 E |
| 3,824,814 | 7/1974 | Fleissner | 68/158 X |
| 3,841,910 | 10/1974 | Baker | 134/15 |
| 4,152,908 | 5/1979 | Bertoldi | 68/158 X |
| 4,280,343 | 7/1981 | Fleissner | 68/184 X |

FOREIGN PATENT DOCUMENTS

| | | | |
|---|---|---|---|
| 2734768 | 2/1979 | Fed. Rep. of Germany | 68/DIG. 5 |
| 94403 | 6/1959 | Norway | 68/158 |

*Primary Examiner*—Philip R. Coe

[57] ABSTRACT

The material to be treated is passed through a narrow passageway. Treating fluid is inserted in one end of the passageway and near the opposite end of the passageway, the fluid treating is withdrawn from the narrow passageway. Pressure seals are used adjacent the entrance and exit of the passageway to seal the treating fluid within the passageway.

1 Claim, 1 Drawing Figure

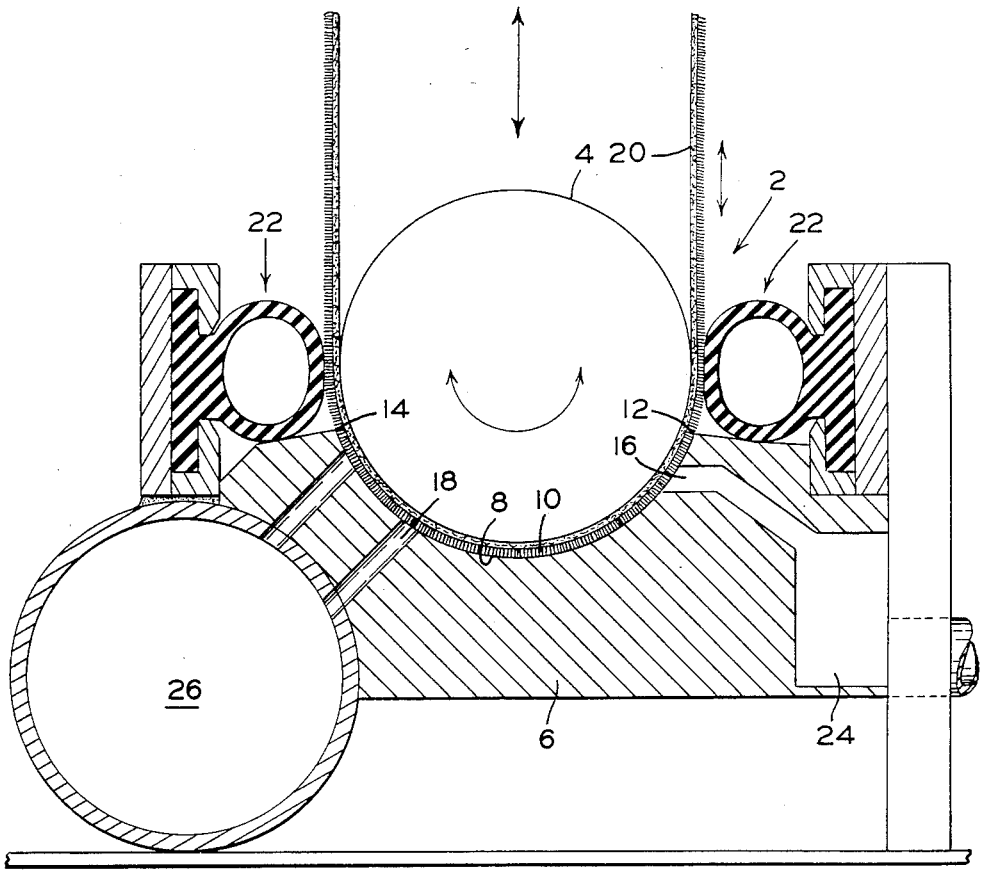
4
20
2
22
22
14
12
16
18
8
10
26
6
24

LIQUID TREATING APPARATUS

BACKGROUND OF THE INVENTION

1. Field of the Invention

The invention is directed to a fluid treating apparatus and, more particularly, to an apparatus for cleaning carpet.

2. Description of the Prior Art

U.S. Pat. No. 2,773,312 illustrates a sealed chamber through which fabric passes having means to introduce steam into the chamber and to draw steam separately out of the chamber so that it does not again pass through the fabric.

U.S. Pat. No. 3,841,910 discloses a liquid extracting apparatus for a porous web wherein a jet is applied to the web through one nozzle and then the web moves over a subsequent suction nozzle which removes material from the web.

U.S. Pat. No. 3,645,116 discloses a concept of employing an inflatable seal to close the openings of the treatment chamber for a cloth web. The interior of the treatment chamber may be under a vacuum or pressurized.

SUMMARY OF THE INVENTION

The invention is directed to a fluid treating apparatus comprising a narrow passageway which is slightly wider than the width of the material to be treated and is no more than three times the height of the material to be treated. Near one end of the passageway there is a fluid inlet means and at the opposite end of the passageway, there is a fluid outlet means. Both the inlet and outlet means are spaced from the ends of the passageway. Both ends of the passageway contain a sheet of material for treatment and an inflated sealing means seals the ends of the passageway. A fluid is provided to the inlet means to place fluid within the passageway near one end thereof and the fluid will move along with the sheet of material as it passes through the passageway. The fluid is removed from the passageway at the outlet means near the opposite end of the passageway just prior to the time the sheet of material exits the passageway.

BRIEF DESCRIPTION OF THE DRAWING

The FIGURE of the drawing is a representation of the apparatus for carrying out the invention herein.

DESCRIPTION OF THE PREFERRED EMBODIMENT

The principle of the invention herein is to control or channel the fluid treating medium along the curvature of a carpet which is passing through a passageway created by a backup roll and the curved wear surface of a vacuum pipe. Under normal circumstances, the liquid to wash a carpet or the air required to dewater the carpet is drawn to the vacuum pipe through the carpet. Herein fluid is channeled to enter at one side of the curved wear surface and to be discharged at the opposite side of the curved wear surface. The channeling of the water or air should provide a much higher degree of fluid contact with the carpet fibers and reduce horse power requirements for any vacuum system used. Consequently, the fluid herein could either be air which is drying the carpet or water which is washing the carpet or even dye which is dyeing the carpet or solvent for washing, dyeing, drying, etc.

The invention herein is best shown in the attached drawing wherein the fluid treating apparatus 2 is shown. The apparatus is composed primarily of a backup roll 4 and a solid block or vacuum pipe 6. Vacuum pipe 6 has a curved wear surface 8 which matches up with the curved surface of the backup roll 4 to define a passageway 10 which starts at point 12 and extends to point 14. The position of the backup roll relative to the curved surface 8 is so adjusted that the distance between the surface of the backup roll, one wall of the passageway, and the surface 8, the other wall of the passageway is equal to approximately 3 times the thickness of the material passing through the passageway 10. Naturally, the length of the roll and the vacuum pipe 6 would be such that the width of the web of material to be treated is accommodated with just a slight clearance space for the width of the web. The ends of the roll and vacuum pipe are sealed to prevent the escape of fluid. Adjacent the point 12 of the passageway there is positioned an inlet 16 which will permit a fluid to be inserted into passageway 10. At the opposite point 14 of the passageway, and positioned just short of the end of the passageway there is an outlet means 18 which permits a fluid to be removed from the passageway 10. Consequently, the flow of the fluid through the passageway would be approximately from the inlet 16 along with passageway to the outlet 18. Naturally, there must be some type of opening and exit for the passageway 10 to permit material, such as carpet 20 to be inserted thereinto. One cannot permit an uncontrolled opening and exit or else the treating fluid will be gushing out of the entrance and exit of the passageway. In order to seal both the entrance and exit of the passageway, there is provided an inflatable seal 22 at both the exit and entrance of the passageway. A rubber seal is formed with a hollow interior that may be operated in a range of 0 to 20 pounds per square inch. At 0 pressure, the seal is somewhat collapsed and material may be inserted between the seal and the surface of the backup roll 4. With the insertion of an air pressure into the center of the iflatable seal 22, the seal now pushes against the surface of the material moving into the passageway 10 and the backup roll 4 pushes on the opposite side of the material and consequently, a resilient and compliant seal is formed at the entrance to the passageway. A similar type structure is provided at the exit to the passageway, and, consequently, the backup roll 4 and seal 22 form a gap in the passageway which is just sufficient to be completely filled by the material passing through the passageway and this will prevent the escape of the liquid from the passageway. Either heated air or liquid may be provided to the inlet means 16 and appropriate means would be provided to move the fluid into the passageway 24 leading to the inlet means 16. The fluid then passes through inlet 16 into passageway 10. At the outlet 18 of the passageway, there normally would be provided a vacuum producing means which forms a vacuum in chamber 26 and this then is connected with outlet 18 and functions to draw the fluid from the passageway 10 into the vacuum chamber 26.

In operation, the fluid is inserted into inlet 16 and moves along one side of the material 20 as it passes through passageway 10 and the fluid is extracted at the outlet 18 from the passageway 10 permitting the material 20 to exit from the passageway 10 with a substantial amount of the fluid treating means being removed therefrom.

The invention may be carried out with heated air being applied to the passageway for the purpose of drying a carpet which is passing through the passageway 10. Likewise, the fluid could be water which would be washing the carpet as it passes through the passageway 10. Further, the fluid could be some type of dye or finish or other treating means which is going to color or impart some type of characteristic to the carpet passing through the passageway 10. Furthermore, the invention is not restricted only to carpet but could be utilized to treat any type of fabric.

The fluid flow can be along with or in opposition to the path of movement of the carpet. The system could operate with a pressurized passageway, a vacuum passageway or a combination pressure-vacuum condition wherein pressure is applied at one end of the passageway and vacuum applied at the opposite end of the passageway. Depending on the condition of the system (vacuum, pressure or combination), seals could be used at both ends or at only one end of the passageway.

What is claimed is:

1. A fluid treating apparatus for sheet material comprising:

(a) a narrow arcuate passageway, (1) said passageway being slightly wider than the width of the sheet of material to be treated and being no more than three times the height of the material being treated, (2) directly adjacent one end of said passageway there being an inlet means and directly adjacent the opposite end of said passageway there being an outlet means, both said inlet and outlet means being spaced a short distance from the ends of the passageway and being on the same side of the passageway, (3) both ends of said passageway being open to admit the sheet of material for treating and to exit the same sheet of material after treatment, (b) means providing fluid to the inlet means to place fluid within the passageway so that the fluid will move along one side of the sheet of material as it passes through the passageway, said liquid being removed from the passageway at the outlet means near the opposite end of the passageway just prior to the time the sheet of material exits the passageway, a vacuum source is positioned adjacent the outlet means within the passageway to remove the liquid from the passageway, (c) the open ends of the passageway forming the entrance and exit from the passageway are air tight because of an inflatable seal pressing against one side of the sheet of material and sealing that one side of the sheet of material while pressing the opposite side of the sheet of material against a solid surface, and (d) said passageway being an arcuate passageway with one wall of the passageway formed by a rotatable material contacting roll means and the opposite wall of the passageway being formed by a surface spaced from the rotatable roll, said wall formed by the roll and said surface spaced therefrom being parallel and spaced apart the height of the passageway, said surface having said inlet and outlet means with the inlet and outlet means being in the arcuate passageway.

* * * * *